US005178083A

United States Patent [19]

Duret et al.

[11] Patent Number: 5,178,083

[45] Date of Patent: Jan. 12, 1993

[54] SEWING MACHINE

[75] Inventors: Henri Duret, Ville-La-Grand, France; Antonio Jimenez, Meyrin, Switzerland; Jacques Matthey, Geneva, Switzerland; Michel Combepine, Les Avanchets, Switzerland

[73] Assignee: Mefina SA, Fribourg, Switzerland

[21] Appl. No.: 499,394

[22] PCT Filed: Nov. 21, 1988

[86] PCT No.: PCT/EP88/01058

§ 371 Date: Jun. 11, 1990

§ 102(e) Date: Jun. 11, 1990

[87] PCT Pub. No.: WO90/04064

PCT Pub. Date: Apr. 19, 1990

[30] Foreign Application Priority Data

Oct. 12, 1988 [CH] Switzerland ..... 3806/88

[51] Int. Cl.[5] ..... D05B 69/18

[52] U.S. Cl. ..... 112/277; 112/220; 307/154; 318/551

[58] Field of Search ..... 112/220, 275, 277, 221, 112/453, 259; 318/245, 551; 307/154, 150

[56] References Cited

U.S. PATENT DOCUMENTS

| | | | |
|---|---|---|---|
| 3,736,479 | 5/1973 | Soeda | 318/245 |
| 3,898,542 | 8/1975 | Current | 307/154 |
| 4,098,206 | 7/1978 | Suchsland et al. | 112/220 |

FOREIGN PATENT DOCUMENTS

| | | | |
|---|---|---|---|
| 83068 | 7/1983 | European Pat. Off. . | |
| 1356238 | 2/1964 | France . | |
| 2603912 | 3/1988 | France . | |
| 2610014 | 7/1988 | France . | |
| 2-084993 | 3/1990 | Japan | 112/259 |
| 2-104389 | 4/1990 | Japan | 112/220 |
| 2-104390 | 4/1990 | Japan | 112/220 |
| 448696 | 12/1967 | Switzerland . | |
| 459336 | 9/1968 | Switzerland . | |

OTHER PUBLICATIONS

Patent Abstracts of Japan, vol. 4, No. 170 (E-35) 652 Nov. 22, 1980 A-55-117493.

Patent Abstracts of Japan, vol. 6, No. 103 (E-112) 981 Jun. 12, 1982 A-57-34795.

*Primary Examiner*—Peter Nerbun

*Attorney, Agent, or Firm*—Cushman, Darby & Cushman

[57] ABSTRACT

A sewing machine is disclosed having an electric circuit divided into a first high-voltage section and a second low voltage section. The second section is supplied via a step-down transformer connected to the first section. The second section has a rectifier connected to the output of the transformer for dispensing DC power to the functional elements of the machine. The first circuit section, the transformer and some elements of the second section are contained in a remote housing which is separate from the machine and is linked to it by a cable. A foot pedal for actuating the machine is integral with the housing.

9 Claims, 2 Drawing Sheets

SEWING MACHINE

The appearance on the market of computer-controlled electronic sewing machines has only very slightly modified the dimensions and general aesthetics of the machine. Although the machines have become much more efficient than conventional mechanically-controlled machines, inter alia machines controlled by cams which are much bulkier in proportion than the "solid state" memories which have replaced them, their casings have remained practically unchanged with regard to their general shape and the volume of their essential parts—i.e. the bottom arm and the top arm and, more particularly, the column connecting the arms.

The aforementioned memories now occupy much less space, and this has enabled numerous manufacturers to dispose them on thin "boards" for forming complete circuits which are so reduced in thickness and area that they can be directly secured e.g. to the column or upper arm of the machine. However there has been practically no decrease in the overall dimensions of the motor and supply transformer which are disposed inside the casings of all machines, and consequently these basic components still determine the size and design of the casing.

Furthermore, since it is absolutely necessary to supply the electronic components of the machine with a low voltage of the order of a few tens of volts, it is necessary to use one or more electric transformers. These of course were not present in prior-art electromechanical machines and they are relatively heavy since they are also designed to deliver the power required for operating the electric motor or motors driving the machine.

The result is that a computer-controlled sewing machine, as compared with an electromechanical sewing machine only a few years old, is as big or even bigger and also and more particularly is heavier, thus increasing the requirements on maintenance and transport, as regards the manufacturer, wholesalers and retailers.

The aforementioned disadvantage is also felt by the user, particularly when the machine is stored in a place difficult of access such as a high shelf.

The aforementioned basic components and the associated electric circuit must also be adapted, for a given model of machine, to the voltage and supply frequency characteristics of the various networks to which sewing machines may be connected. As is known, these characteristics may differ greatly from one country to another, and the same applies to the safety requirements in some countries or groups of countries.

Manufacturers who wish to introduce their products into a large number of countries are therefore forced, in the case of a given model of sewing machine, to manufacture as many types of machines as there are types of requirements on voltage and/or main frequency and/or safety standards to be met by the machine in the chosen countries. This requirement, of course, makes it difficult to rationalize the production chains and warehousing of machines.

As for the user of a sewing machine constructed in accordance with very specific local conditions as regard current supply and safety, he is practically forced to change the machine as soon as he wishes to set up in another region, where the conditions are so different from those from which the machine was designed that it becomes defective or even dangerous in operation unless the electric parts are modified—a particularly laborious and risky operation.

The invention aims precisely to obviate all the aforementioned disadvantages and accordingly proposes a sewing machine designed so as to free the manufacturer and user from the aforementioned aesthetic, practical and economic constraints.

They will now be described with reference to the drawings given by way of example and in which.

Figure 1:
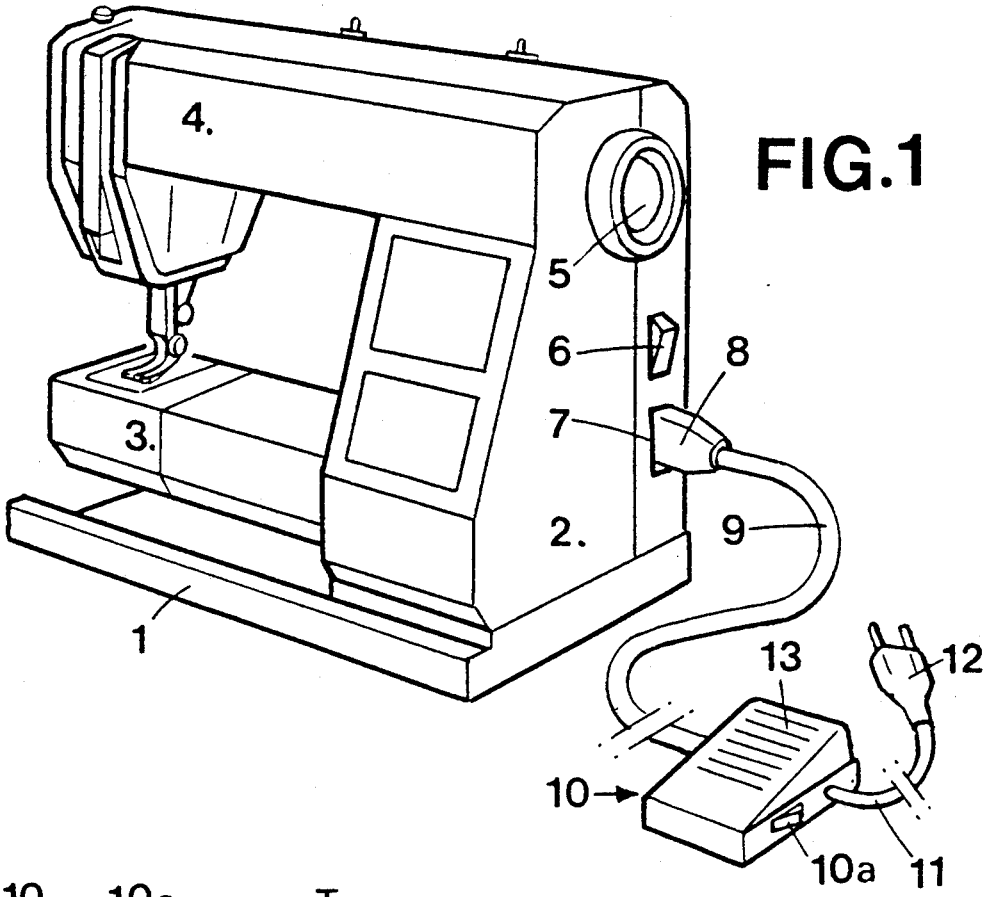
FIG. 1 is a three-quarter elevation of a sewing machine according to the invention.

FIG. 1 shows a machine comprising a base 1 and, at its right end, a column 2 bearing two superposed horizontal arms 3 and 4 containing a fabric drive mechanism and a loop detecting device in the case of the first arm and mechanisms for controlling the needle bar and the thread carrier.

At its right side, the machine in FIG. 1 has a handwheel 5, an operating switch 6 and a multi-pin female connector, only the frame 7 of which is visible in the drawing, the plug being adapted to receive a multiple plug 8 shown at the free end of a cable 9 and comprising a number of conductors extending from a control box 10 for placing on the ground and also secured to a second electric cable 11 and plug 12 for connecting the aforementioned sewing machine to an electric supply (not shown).

The top part of box 10 bears a rocker pedal 13 for actuating the sewing machine, whereas the right side of the box as shown in the drawing bears a master switch 10*a*.

Figure 2:
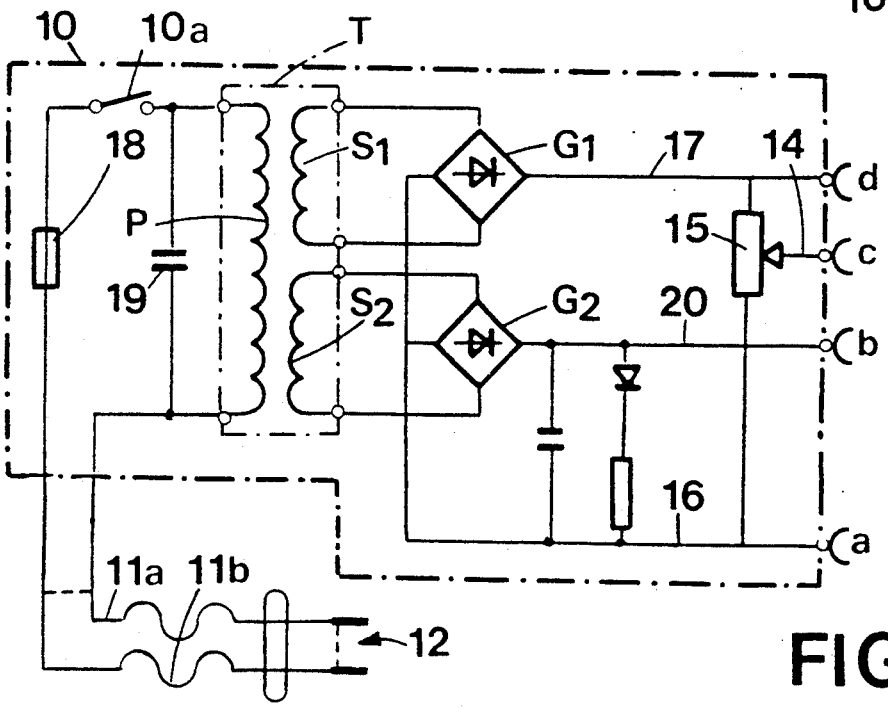
FIG. 2 is a partial view of the electric circuit of the machine, according to a first embodiment.

Pedal 13, which the user can tilt in the usual manner by actuating it with his foot against the action of a return spring (not shown) and then releasing it after the spring acts, causes a cursor 14 connected to a terminal c to move along an ohmic resistor 15 connected between a first line 16 ending at a terminal a connected to ground (not shown) and a second line 17 ending at a terminal d (FIG. 2).

Line 17 is connected to the output of a first "Grätz" bridge $G_1$, the input of which is connected to $S_1$, one of the two secondary windings $S_1$ and $S_2$ of a step-down transformer T. The transformer, whose magnetic core has to been shown, has its primary winding P connected to the conductors 11*a*, 11*b* of cable 11 via the aforementioned switch 10*a* and a fuse 18. An interference-eliminating capacitor 19 is connected to the terminals of winding P of transformer T. A second Grätz bridge $G_2$ has its input connected to the terminals of the secondary winding $S_2$ of transformer T and its output connected to a line 20 ending at a terminal b.

Terminals a, b, c and d are used for connecting four corresponding conductors in cable 9. The conductors are therefore used to supply the machine with direct current, e.g. at a maximum voltage of approx. 15 V between terminals a and d for supplying the electronic part of the machine, and at a voltage of about 30 V between terminals a and b, more particularly for supplying the electric motors (the main motor and the stepping motors).

The voltage at the terminal c for controlling the variation in speed of the motor driving the machine will of course vary with the position of cursor 14 but will be between 15 and 0 volts. Reference should be made to the Applicant's U.S. Pat No. 4,771,714 (FIGS. 10 and 12) for more details concerning the actual method of control.

Figure 3:
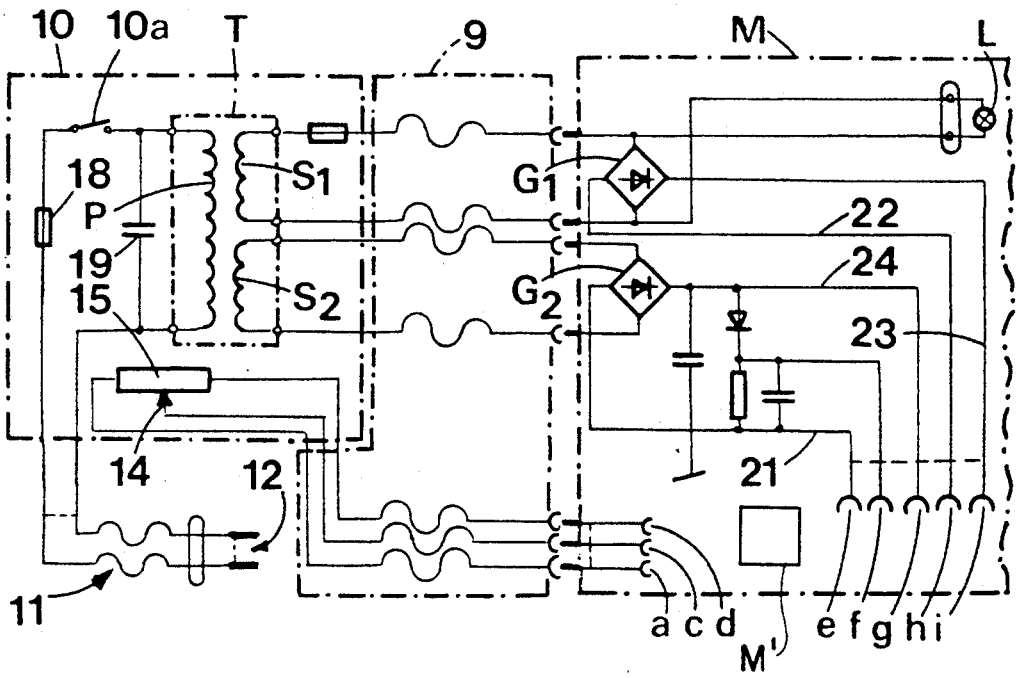
FIG. 3 is a view similar to FIG. 2, according to a second embodiment.

FIG. 3 shows an embodiment differing from that previously described mainly in that the two Grätz bridges $G_1$ and $G_2$ are not disposed in box 10 but inside the machine casing M.

Accordingly the box is attached to the casing not by a cable having four conductors as previously but by a cable having seven conductors, four of which are for connecting the secondary windings $S_1$ and $S_2$ of transformer T to bridge $G_1$ in the case of the first winding and $G_2$ in the case of the second winding. The other three conductors are for connecting the cursor 14 on the one hand and the ends of resistor 15 on the other hand to corresponding points on the circuit (not shown) for controlling the variation in speed of the motor (schematically shown at M') for driving the sewing machine. As before, reference should be made to U.S. Pat. No. 4,771,714 for more details of the control circuit.

As in FIG. 2, the terminal a connected to one end of resistor 15 will be connected to ground and terminal d will be connected to a voltage of the order of 12 to 15 V. The potential at terminal c will therefore be between 0 and 15 V depending on the position of the pedal associated with cursor 14.

One output of the Grätz bridges $G_1$ and $G_2$ is connected by a line 21, 22 to terminals e and h respectively, which are connected to ground.

The other outputs of the bridges are connected to terminal i of bridges $G_1$ and terminal g of bridge $G_2$ by lines 23 and 24 respectively. They are capable e.g. of supplying a dc voltage of 12 to 15 V between terminals i and h and a voltage of the order of 30 V between terminals g and e. The voltage delivered at terminal f is of the same order as that appearing at terminal g.

A control lamp L is used to check that the connection between cable 9 and the sewing machine is operative, when the lamp is directly supplied from the secondary winding $S_1$ of transformer T.

Figure 4:
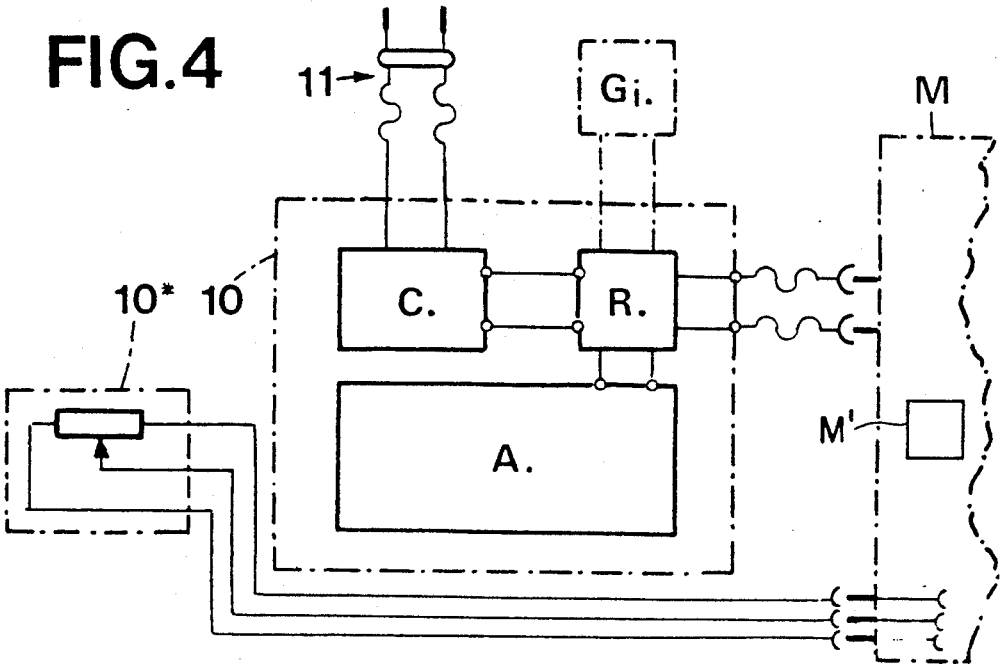
FIG. 4 is a block diagram of a part of the electric circuit of the sewing machine according to a third embodiment.

In the embodiment in FIG. 4, the machine according to the invention comprises one or more "buffer" accumulators A for compensating any deficiencies in the supply network, i.e. an excessive drop in rated voltage or short interruptions in current.

The pedal for actuating the machine is also integral with a casing 10* independent of casing 10. Casing 10* contains the variable resistor associated with the pedal, whereas casing 10 contains the set of components for supplying the machine (casing M) with a low dc voltage from the ac network.

The last-mentioned means comprise the accumulator battery A and a charger C for connecting to an AC supply network via cord 11. The output of charger C delivers a rectified voltage of a few tens of volts and is connected to a voltage regulator R for supplying the battery A as long as the voltage at the terminals thereof is below the rated voltage at the output of charger C. whereas the battery is connected to the circuit for supplying the sewing machine as soon as the voltage delivered by charger C becomes less than the rated voltage.

The structure and operation of components A, C and R are conventional and therefore well-known to the skilled addressee.

In a variant embodiment, the buffer battery A could also be supplied by an electric energy source independent of any electric supply network. For example regulator R can be connected to a generator $G_i$ which can comprise one or more solar panels, or can be driven e.g. by a windmill.

Of course, generator $G_i$ can be dimensioned so as to deliver all the power necessary for proper operation of the machine so that the machine can if necessary be used even if no supply network is available or if the current supplied by the network is interrupted for a particularly long period.

Of course in a variant (not shown) there is nothing to prevent incorporating the control pedal and associated variable resistor in the casing 10, in similar manner to the embodiments in FIGS. 2 and 3.

It is also clear that, inter alia in the case of the embodiment in FIG. 3, the pedal and variable resistor could perfectly well be disposed in a casing independent of the casing containing the step-down transformer.

The technical features used in the various embodiments described hereinbefore can effectively obviate the disadvantages pointed out in the prior-art machines.

It is possible, for example, by sub-dividing the various components of a sewing machine as described, to improve the efficiency of construction, manufacture, storage, transport and manipulation by the user, and also to ensure that the electric part of the actual sewing unit is completely at low voltage (about 30 V) and so that the voltage-step down transformer is disposed in an independent casing resting on the ground, i.e. sufficiently distant from the integrated circuits of the electronic parts of the machine to prevent them being influenced by the leakage field of the transformer. The harmful effect of this field on the electronic circuits is well-known to the skilled addressee.

Finally, in the case where the control pedal and step-down transformer are associated in a common casing (FIGS. 1 and 2), the weight of the assembly is such that the pedal cannot be moved too easily on the ground by a user blindly searching for the pedal with his foot.

We claim:

1. An electric low voltage sewing machine, comprising:

a casing;

a high voltage circuit section;

a low votlage circuit section having first and second circuit portions, said first portion of said low voltage circuit section generating a low votlage output and said second circuit portion comprising a motor;

a step down transformer having primary and secondary windings connected to said high voltage circuit section and to said first portion of said low voltage circuit section, respectively;

first means for connecting said first portion of said low voltage section to said second portion of said low voltage section to present said low voltage output to said second circuit portion in a substantially unchanged form; and a foot pedal actuator having a housing containing means for controlling the machine, said high voltage circuit section, said transformer and said first portion of said low voltage circuit section;

wherein said second circuit portion is disposed in said casing.

2. A machine as in claim 1, said first portion of said low voltage circuit section comprising:

at least one rectifying assembly having an input connected to said secondary winding of said transformer and an output;

wherein said first means connects said output of said rectifying assembly to said second portion of said low voltage circuit section.

3. A machine as in claim 1, said second portion of said low voltage circuit section comprising:

at least one rectifying assembly having an input and an output;

wherein said first means connects said secondary winding of said transformer to said input of said rectifying assembly.

4. A machine as in claim 3, said second portion of said low voltage circuit section further comprising:

a control lamp electrically connected to said input of said rectifying assembly.

5. A machine as in claim 8, further comprising:

a buffer battery having terminals;

a voltage regulator having a first input connected to the output of a charger and a second input connected to said terminals of said battery;

means for comparing the value of the voltage at said first input and the value of the voltage at said second input;

second means for connecting the terminals of said battery selectively to said charger output, if the voltage at said second input of the regulator is lower than the voltage at said first input thereof, and to said second portion of said low voltage circuit section through said first means, if the voltage at said second input of the regulator is higher.

6. A machine as in claim 2, further comprising:

a buffer battery having terminals;

a DC supply means having an output for delivering a signal having a rated voltage substantially equal to the value of the voltage at the output of said rectifying assembly;

a voltage regulator having a first input connected to said DC supply means output and a second input connected to said terminals;

means for comparing the value of the voltage at said first input and the value of the voltage at said second input; and means for connecting the terminal of said buffer battery selectively to said DC supply means, if the voltage at said second input is lower than the voltage at said first input, and to said second portion of said low votlage circuit section through said first connecting means, if the voltage at said second input of the regulator is higher.

7. An electric low voltage sewing machine, comprising:

a casing;

a high voltage circuit section;

a low voltage circuit section having first and second circuit portions, said second portion comprising a motor and a rectifying assembly;

a step down transformer having primary and secondary windings connected to said high voltage circuit section and to said fist portion of said low voltage circuit section, respectively;

first means for connecting said first portion of said low voltage section to said second portion of said low voltage section; and a foot pedal actuator having a housing containing means for controlling the machine, said high voltage circuit section, said transformer and said first portion of said low voltage circuit section;

wherein said second circuit portion is disposed in said casing.

8. A machine as in claim 7, wherein:

said rectifying assembly has an input and an output; and said first means connects said secondary winding of said transformer to said input of said rectifying assembly.

9. A machine as in claim 8, wherein said second portion of said low voltage circuit section further comprises:

a control lamp electrically connected to said input of said rectifying assembly.

* * * * *

UNITED STATES PATENT AND TRADEMARK OFFICE

CERTIFICATE OF CORRECTION

PATENT NO. : 5,178,083

DATED : January 12, 1993

INVENTOR(S) : DURET et al.

It is certified that error appears in the above-identified patent and that said Letters Patent is hereby corrected as shown below:

IN THE CLAIMS:

Column 5, line 18,
Claim 5, change "8" to --2--.

Signed and Sealed this

Eighth Day of February, 1994

*Attest:*

*Attesting Officer*

BRUCE LEHMAN

*Commissioner of Patents and Trademarks*